United States Patent [19]

Croft

[11] Patent Number: 4,709,624

[45] Date of Patent: Dec. 1, 1987

[54] APERTURE SEAL FOR A ROOF MOUNTED VENTILATOR AND METHOD FOR MAKING SAME

[76] Inventor: John E. Croft, 4695 Littlefield, Beaumont, Tex. 77706

[21] Appl. No.: 776,366

[22] Filed: Sep. 16, 1985

[51] Int. Cl.[4] ..... F24F 7/00

[52] U.S. Cl. ..... 98/119; 52/98; 52/127.1; 52/420; 156/71; 156/291

[58] Field of Search ..... 52/420, 127, 127.1, 52/127.8, 94, 98, 127.7; 98/29, 116, 119; 156/71, 291

[56] References Cited

U.S. PATENT DOCUMENTS

| | | | |
|---|---|---|---|
| 2,956,703 | 10/1960 | Royal | 156/71 |
| 3,182,423 | 5/1965 | Jennings | 52/127.1 X |
| 3,307,306 | 3/1967 | Oliver | 52/420 X |
| 4,021,981 | 5/1977 | Van Wagoner | 156/71 X |
| 4,204,373 | 5/1980 | Davidson | 52/204 |
| 4,287,815 | 9/1981 | Henderson | 8/42.07 |
| 4,452,022 | 6/1984 | Bezborodka | 52/420 X |
| 4,520,715 | 6/1985 | Coomes et al. | 98/119 X |

*Primary Examiner*—Harold Joyce
*Attorney, Agent, or Firm*—Kenneth D. Baugh

[57] ABSTRACT

An aperture seal (30) is providing including a base member (32) having an insulating member (34) coupled thereto. A cover member (36) is coupled to the insulating member (34) on a side opposite the base member (32). A bead of sealant (38) is coupled around the periphery of the cover member (36). A second cover member (42) is provided to hold and protect the bead of sealant (38) in the first cover member (36) until the bead of sealant is released to secure the aperture seal (30) to the roof (12) and close the roof ventilator aperture (14).

14 Claims, 5 Drawing Figures

APERTURE SEAL FOR A ROOF MOUNTED VENTILATOR AND METHOD FOR MAKING SAME

TECHNICAL FIELD

This invention relates to a ventilating system and more particularly to an aperture seal for closing and sealing apertures below roof ventilators during the cold months of the year.

With the increasing need for consumer conservation of power, many systems have been developed to assist in this endeavor. One such system is the ventilator used on residential dwellings. The ventilator systems are of generally two types, the wind driven turbine type ventilator and the power type ventilator. Both systems which are well known are generally roof mounted over an aperture in the roof. This allows the ventilator to dissipate moisture in the air and heat contained within the attic of the dwelling. This dissipation of heat and moisture obviously results in the cooling system of the dwelling having to do less work. Thus less energy is consumed during the hotter months of the year.

However, the aperture required to allow the ventilator to communicate with the attic and dissipate moisture and heat therefrom during the hotter months of the year also allows heat loss during the colder months. If the heat generated in the attic during the winter months is contained therein then simular energy savings can be realized in the colder months as are realized during the hotter months. Accordingly it is desirable to close the ventilator aperture during the colder months to thereby prevent heat loss through the aperture.

BACKGROUND ART

Attempts have been made to provide ventilating systems which prevent heat loss through the ventilator aperture during the colder months of the year.

One such device is disclosed in U.S. Pat. No. 4,231,288. This device includes a disk-like member which is placed over the ventilator aperture. This disk member is held in place by a mechanical member which extends between and is connected to the ventilator and the disk-like member. Another roof ventilating system having a disk-like member is disclosed in U.S. Pat. No. 1,601,191. In this device the disk-like member is threadedly mounted on the aperture for opening and closing when desired.

Another device is disclosed in U.S. Pat. No. 4,287,816. This device includes a separate enclosure designed to be mounted around the ventilator itself during the winter months.

Still other ventilator systems such as for example as is disclosed in U.S. Pat. No. 925,252 discloses a damper like closing member sitting in the aperture which can be opened and closed by a cable when desired.

DISCLOSURE OF THE INVENTION

The invention relates to an aperture seal for closing and sealing roof ventilator apertures and method of making same. The aperture seal in accordance with this invention includes a base member having an insulating member coupled thereto. A first cover means for enhancing heat retention and protecting the insulating member is coupled to the insulating member on the side thereof opposite the base member. An adhesive engaging means for adhesively engaging the roof is coupled to the first cover means. A second cover means is provided to hold the adhesive engaging means in engagement with the first cover means and expose the adhesive engaging means so that the adhesive engaging means can secure the aperture seal to the roof and close the roof ventilator aperture.

A method for making an aperture seal for sealing a roof ventilator aperture in accordance with this invention includes the first step of aligning a base member having a predetermined configuration and dimensions adjacent to an insulating member. The insulating member is then coupled to the base member. Once the insulating member is coupled to the base member a cover member for enhancing heat retention and protecting the insulating member is aligned with and secured to the insulating member on the side thereof opposite the base member. A bead of sealant of predetermined dimension is then affixed around the periphery of the cover member. A protective holding member is then placed over the sealant and secured to the cover member.

BRIEF DESCRIPTION OF THE DRAWING

The details of the invention will be described in connection with the accompanying drawing in which.

BEST MODE FOR CARRYING OUT THE INVENTION

Figure 1:
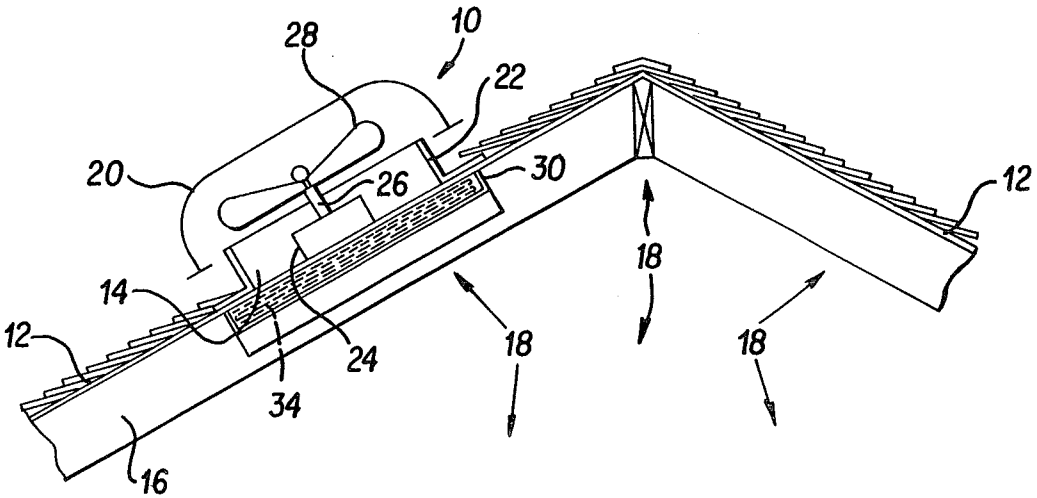
FIG. 1 is a fragmentary elevational and cross sectional view of a roof and power-type ventilator illustrating the ventilator aperture seal in accordance with the principles of this invention.

Referring to FIG. 1 there is shown, a Power Attic Ventilator generally designated by the numeral 10 which is mounted to a roof 12 of a dwelling (not shown) in a ventilator aperture 14.

The roof 12 of the dwelling, as is well known overlies an attic area 18 of the dwelling. The ventilator aperture 14 which is formed in the roof 12 between parallel roof rafters 16 (only one shown) provide access for the power ventilator 10 to the attic area of the dwelling. The power ventilator 10 is of conventional construction and includes cover assembly 20 which is mounted to a support member 22. The support member 22 facilitates mounting and securing of the power ventilator 10 on the roof 12. The power ventilator 10 also includes a drive motor 24 having a shaft 26 rotatably mounted thereto to rotate a fan blade 28 upon activation of the motor. The power ventilator 10 when in operation serves to facilitate removal of hot air and moisture from the attic thus helping to conserve energy and reduce cooling bills.

Figure 2:
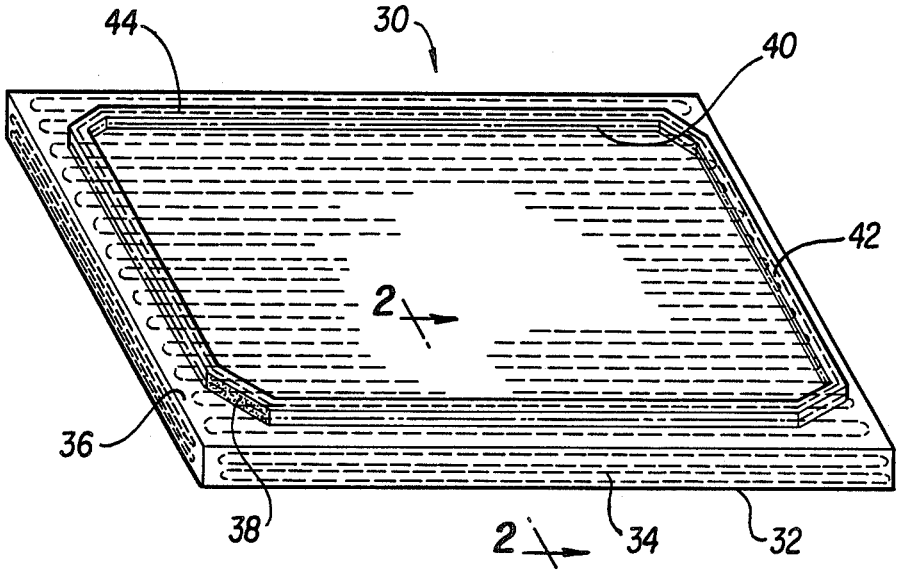
FIG. 2 is a perspective view of the ventilator aperture seal in accordance with the principles of this invention.
Figure 3:
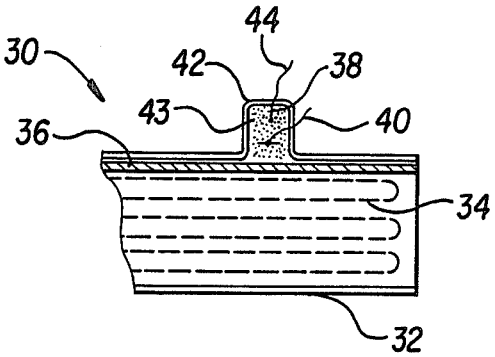
FIG. 3 is a cross-sectional view of the aperture seal taken along line 2—2 of FIG. 2.

Referring to FIGS. 2 and 3 an aperture seal 30 in accordance with this invention is provided to cover and seal the aperture 14 in the roof 12 during cold months. This allows heat to be contained in the dwelling.

The aperture seal 30 is formed of a rectangular shaped or square base member 32. The base member 32 may be formed of or fabricated from a fire retardant material and may for example be aluminum foil. The base member 32 has a width and length sufficient to cover the ventilator aperture 14 and may be for example nineteen inches in length and nineteen inches in width. The aperture seal 30 also includes an insulating member 34. The insulating member 34 is provided to facilitate the retention of heat and thereby retard the escape of heat through the ventilator aperture 14. The insulating member 34 is designed to have the same configuration as the base member 32 and is one-half inch in thickness. The insulating member 34 may be made of spin glass such as for example the type known as 814FSK.

A protective cover 36 is coupled to the side of the insulating member 34 opposite the base member 32. The cover 36 helps to enhance the life of the insulating member 34 as well as contribute to the insulating members heat retention qualities. The protective cover 36 may be made for example of a sheet of foil backing or other such material having the aforementioned properties.

A longitudinally extending bead of sealant 38 is affixed around the periphery of the cover member 36 about one half inch from the covers' edge. The bead of sealant 38 is an adhesive member one-half inch in diameter and one-half inch high which secures and holds the aperture seal 30 in intimate air tight engagement with the roof 12 of the dwelling (FIG. 1). The bead of sealant 38 is of sufficient quality and size to allow quick sealing upon engagement with the cover member 36 and the roof 12 and may be for example a silicon type sealant. The bead of sealant 38 may be provided with a string 40 embedded therein. The string 40 may be embedded in an S-like configuration. The string 40 allows easy removal and disengagement of the sealant bead 38 from the roof 12 once it hardens simply by pulling the string. This allows the aperture seal 30 to be removed. A member 42 fabricated having a slot 43 formed therein is provided adjacent to and in engagement with bead of sealant 38 and cover member 36 to hold the bead of sealant in the slot position on the cover member. The member 42 also protects the bead of sealant 38 from damage and helps it to retain its adhesive qualities until it is ready for use. The member 42 may be for example made of aluminum foil. A string 44 is coupled to the member 42 to permit easy removal of the member 42 thereby exposing the sealant 38 and allowing access to the sealant 38 when the aperture seal is to be used. The string 44 as well as the string 40 may be for example made of nylon or a similar material.

When it becomes necessary to close the ventilator aperture 14 during the colder months of the year the aperture seal 30 is used. The aperture seal is installed from inside the attic area 18 of the dwelling. To install the aperture seal 30 it is first necessary to pull the string 44 to expose the bead of sealant 38. The aperture seal 30 is then aligned to cover the ventilator aperture 14 and moved into engagement with the roof 12. The aperture seal 30 can then be held in place for a few seconds until the bead of sealant 38 has set and provided an air tight seal around the ventilator aperture 14. The aperture seal 30 is provided to accommodate those situations where the ventilator aperture 14 is not centrally located between the roof rafters 16.

Figure 4:
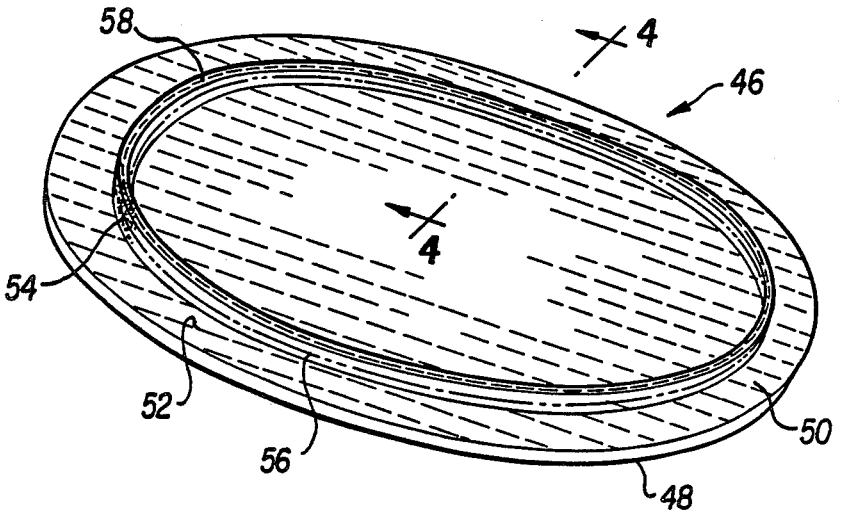
FIG. 4 is a perspective view of a second embodiment of the aperture seal in accordance with the principles of this invention.
Figure 5:
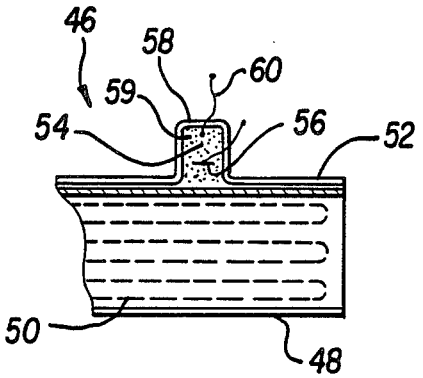
FIG. 5 is a cross-sectional view of the second embodiment of the aperture seal taken along line 4—4 of FIG. 4.

A second embodiment of the invention is illustrated in FIGS. 4 and 5. An aperture seal 46 is provided having a substantially circular configuration. The aperture seal 46 is provided to accommodate those situations where the ventilator aperture 14 is centrally located between the roof rafters 16. In this situation the circularly configured aperture seal 46 assures that a secure and air tight seal is achieved.

The aperture seal 46 is formed of a base member 48 of circular configuration having an insulating member 50 coupled thereto. A protective cover 52 is coupled to the insulating member 50 on the side thereof opposite the base member 48. A bead of sealant 54 which may have a string 56 embedded therein is provided along the periphery of the cover 52 and held in place on the cover and protected by a member 58 having a slot 59 formed therein to receive the sealant (FIG. 5). A second string 60 is coupled to the member 58 to permit access to the bead of sealant 54 when sealing is required.

The aperture seal 46 may have a diameter of 14½ inches which will normally be sufficient to cover the typical aperture 14. The aperture seal 46 is made of the same material and has the same thickness as the aperture seal 30 described in the first embodiment. Additionally the aperture seal 46 is placed into operation just as was previously described with regard to the aperture seal 30.

In order to make an aperture seal 30 inaccordance with this invention one must first align the a base member 32 of the shape and dimensions described herein adjacent to the insulating member 34. Once the base member 32 is aligned adjacent to the insulating member 34 the insulating member is then coupled to the base member. The insulating member may be coupled to the base member in a number of well know ways such as for example by an adhesive. The protective cover member 36 is then aligned with and attached securely to the insulating member 34 on the side thereof opposite the base member 32. This can also be achieved for example with an adhesive or some other reliable coupling means. After coupling the protective cover 36 to the insulating member 34 the bead of sealant 38 is applied and affixed around the periphery of the cover member 36. The member 42 is then placed over the bead of sealant 38 and secured to the cover member 36. Before the bead of sealant 38 is covered the string 44 is integrally formed in the member 42 so that the member 42 can be readily removed and thus allow access to the bead of sealant as previously described.

When it is desired to provide an aperture seal 30 having the string 40 embedded in the bead of sealant 38 the sealant would then be applied in two steps. First a first layer of sealant would be applied around the periphery of the cover 36. Once this is accomplished the string 40 would be laid in the first layer of sealant. A second layer of sealant would then be applied over the first layer so that the bead of sealant 38 is formed and the string is held within the bead of sealant.

In a second embodiment of the process the string 44 is placed in the slot 43 of the member 42 once the protective cover member 36 and insulating member 34 are coupled together. The bead of sealant 38 is then placed in the slot 43 of the member 42. The member 42 is then aligned with and coupled to the protective cover member 36 so that the sealant engages the periphery of the protective cover.

When it is desired in this embodiment of the process to provide the string 40 embedded in the bead of sealant 38 the sealant would be applied in two steps. That is a first layer of sealant is placed in the slot 43 over the string 44 in the member 42. Once this is done the string 40 is laid in the first layer of sealant. A second layer of sealant is then applied over the first layer so that the bead of sealant 38 is formed and the string 40 is held within the bead of sealant.

It should be understood that the process for making the aperture seal inaccordance with this invention was described in conjunction with the first embodiment that is aperture seal 30 for illustration purposes only and that the steps heretofore described are just as applicable to making the aperture seal 46.

The invention has been shown and described herein in what is considered to be the most practical and preferred embodiments. However, it should be recognized that changes may be made by those skilled in the art without departing from the spirit and scope of the invention.

What is claimed is:

1. An aperture seal for closing and scaling a ventilator aperture in a roof including:

a base member;

an insulating member aligned with and coupled to the base member;

a first cover means aligned with the coupled to the insulating member on the side thereof opposite the base member for enhancing heat retention and for protecting the insulating member;

means coupled to the first cover means for adhesively engaging the roof;

a second cover means for holding and protecting the adhesively engaging means on the first cover means and for allowing exposure of the adhesively engaging means so that the adhesively engaging means can secure the aperture seal to the roof and close the ventilator aperture.

2. An aperture seal as defined in claim 1 wherein the adhesively engaging means includes a bead of sealant affixed around the periphery of the first cover means.

3. An aperture seal as defined in claim 2 wherein the second cover means includes:

a first member aligned to engage and cover the bead of sealant; and a second member coupled to the first member for allowing exposure of the sealant so that the sealant can engage the roof.

4. An aperture seal as defined in claim 3 wherein the second member of the second cover member is a string coupled to the first member of the second cover means.

5. An aperture seal as defined in claim 4 wherein the adhesively engaging means further includes a means for disengaging the sealant from the roof.

6. An aperture seal as defined in claim 5 wherein the sealant disengaging means includes a string embedded in the sealant.

7. An aperture seal as defined in claim 6 wherein the base member is of substantially rectangular configuration.

8. An aperture seal as defined in claim 6 wherein the base member is of substantially circular configuration.

9. A method for making an aperture seal for closing and sealing a roof ventilator aperture including the steps of:

fabricating a base member of predetermined dimensions and configuration; aligning an insulating member having substantially the same configuration as the base member adjacent to the base member;

coupling the insulating member to the base member;

applying a protective cover to the insulating member on a side thereof opposite the base member so that the protective cover is secured to the insulating member;

affixing a bead of sealant around the periphery of the protective cover; and applying a holding member to the protective cover to secure the bead of sealant to the cover.

10. A method of making an aperture seal as defined in claim 9 further including the step of securing an exposing member to the holding member before the holding member is applied to the protective cover so that the bead of sealant can be exposed and engage the roof.

11. A method of making an aperture seal for closing and sealing a roof ventilator aperture including the steps of:

fabricating a base member of predetermined dimensions and configurations;

aligning an insulating member having substantially the same configuration as the base member adjacent to the base member;

coupling the insulating member to the base member;

applying a protective cover to the insulating member on a side thereof opposite the base member so that the cover is secured to the insulating member;

affixing a first layer of sealant around the periphery of the cover;

embedding a string in the first layer of sealant in a predetermined configuration;

applying a second layer of sealant on top of the first layer of sealant;

applying a holding member to the protective cover to secure the sealant on the cover; and securing a string to the holding member to allow removal of the cover from the sealant.

12. A method for making an aperture seal for closing and sealing a roof ventilator aperture including the steps of:

fabricating a base member of predetermined dimensions and configuration;

aligning an insulating member having substantially the same configuration as the base member adjacent to the base member;

coupling the insulating member to the base member;

applying a protective cover to the insulating member on a side thereof opposite the base member so that the cover is secured to the insulating member;

fabricating a holding member of a predetermined configuration;

applying a bead of sealant to the holding member; and coupling the holding member to the protective cover to secure the bead of sealant to the cover.

13. A method of making an aperture seal as defined in claim 12 further including the step of securing an exposing member to the holding member before the bead of sealant is applied to the holding member so that the bead of sealant can be exposed and engage the roof.

14. A method of making an aperture seal for closing and sealing a roof ventilator aperture including the steps of:

fabricating a base member of predetermined dimensions and configuration;

aligning an insulating member having substantially the same configuration as the base member adjacent to the base member;

coupling the insulating member to the base member;

applying a protective cover to the insulating member on a side thereof opposite the base member so that the cover is secured to the insulating member;

fabricating a holding member of a predetermined configuration;

aligning a first string to engage the holding member;

applying a first layer of sealant to the holding member in engagement with the string;

embedding a second string in the first layer of sealant in a predetermined configuration;

applying a second layer of sealant on top of the first layer of sealant; and coupling the holding member to the protective cover to secure the bead of sealant to the cover.

* * * * *